US011794331B2

(12) United States Patent
Chen

(10) Patent No.: US 11,794,331 B2
(45) Date of Patent: Oct. 24, 2023

(54) REPLACEABLE TOOL

(71) Applicant: Jun-Fan Chen, Taichung (TW)

(72) Inventor: Jun-Fan Chen, Taichung (TW)

( * ) Notice: Subject to any disclaimer, the term of this patent is extended or adjusted under 35 U.S.C. 154(b) by 162 days.

(21) Appl. No.: 17/369,144

(22) Filed: Jul. 7, 2021

(65) Prior Publication Data

US 2023/0012425 A1 Jan. 12, 2023

(51) Int. Cl.

| | |
|---|---|
| ***B25G 3/24*** | (2006.01) |
| ***B25B 23/00*** | (2006.01) |
| *B25D 3/00* | (2006.01) |

(52) U.S. Cl.

CPC ..... *B25G 3/24* (2013.01); *B25B 23/0035* (2013.01); *B25D 3/00* (2013.01)

(58) Field of Classification Search

CPC ..... B25G 3/24; B25B 23/0035; B25D 3/00
USPC ..... 81/125, 25, 177.85
See application file for complete search history.

(56) References Cited

U.S. PATENT DOCUMENTS

| | | | | |
|---|---|---|---|---|
| 33,899 A * | 12/1861 | Morrill | B23B 31/103 | 81/125 |
| 1,269,413 A * | 6/1918 | Finnigan | B25B 23/0021 | 112/80.03 |
| 2,885,780 A * | 5/1959 | Campbell | B26B 1/08 | 30/162 |
| 3,974,868 A * | 8/1976 | Derbyshire | B25G 3/26 | 30/340 |
| 7,587,791 B2 * | 9/2009 | Liou | B25G 3/18 | 81/177.1 |

* cited by examiner

*Primary Examiner* — Hadi Shakeri
(74) *Attorney, Agent, or Firm* — MUNCY, GEISSLER, OLDS & LOWE, P.C.

(57) ABSTRACT

A replaceable tool is provided, including: a main body, including a connecting hole extending along a first axis; a control member, inserted within the main body and including a detent member, being movable between a locked position and a release position along a second axis lateral to the first axis; wherein when the control member is located in the locked position, the detent member radially protrudes within the connecting hole; when the control member moves from the locked position to the release position, the detent member is away from the first axis.

10 Claims, 4 Drawing Sheets

REPLACEABLE TOOL

BACKGROUND OF THE INVENTION

Field of the Invention

The present invention relates to a replaceable tool.

Description of the Prior Art

In many operations, auxiliary tools are often used, wherein the auxiliary tools may be tapping, locking, disassembling or extension tools.

The main body and working head of a conventional hand tool are mostly formed of one piece. Although the conventional hand tool has good structural strength, it is not suitable for a variety of different specifications and operation requirements. Therefore, it is necessary to prepare tools of different types and/or sizes, and thus it results in high cost and weight, and occupies more space.

There is another type of conventionally hand tool whose main body and working head are assembled by a bolt and a nut. However, it has to disassemble and assemble bolt and the nut in each replacement of the conventionally hand tool, which is inconvenient, time-consuming and labor-intensive.

The present invention is, therefore, arisen to obviate or at least mitigate the above-mentioned disadvantages.

SUMMARY OF THE INVENTION

The main object of the present invention is to provide a replaceable tool which is quick and easy to replace.

To achieve the above and other objects, a replaceable tool is provided, including: a main body, including a connecting hole extending along a first axis; a control member, inserted within the main body and including a detent member, being movable between a locked position and a release position along a second axis lateral to the first axis; wherein when the control member is located in the locked position, the detent member radially protrudes within the connecting hole; when the control member moves from the locked position to the release position, the detent member is away from the first axis.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
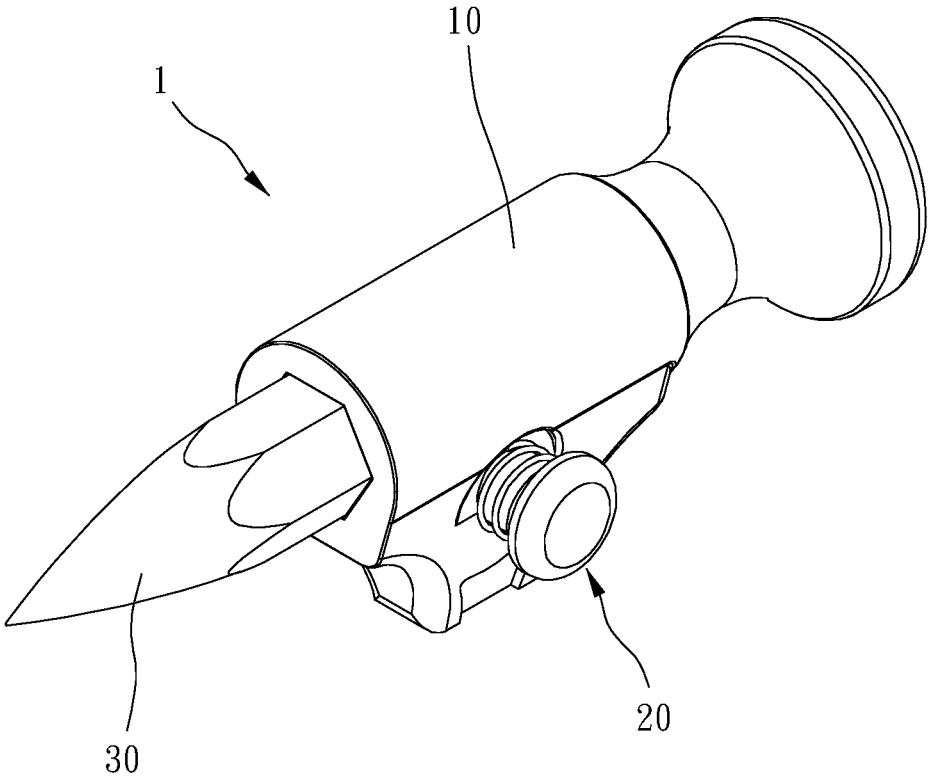
FIG. 1 is a stereogram of a preferable embodiment of the present invention.
Figure 2:
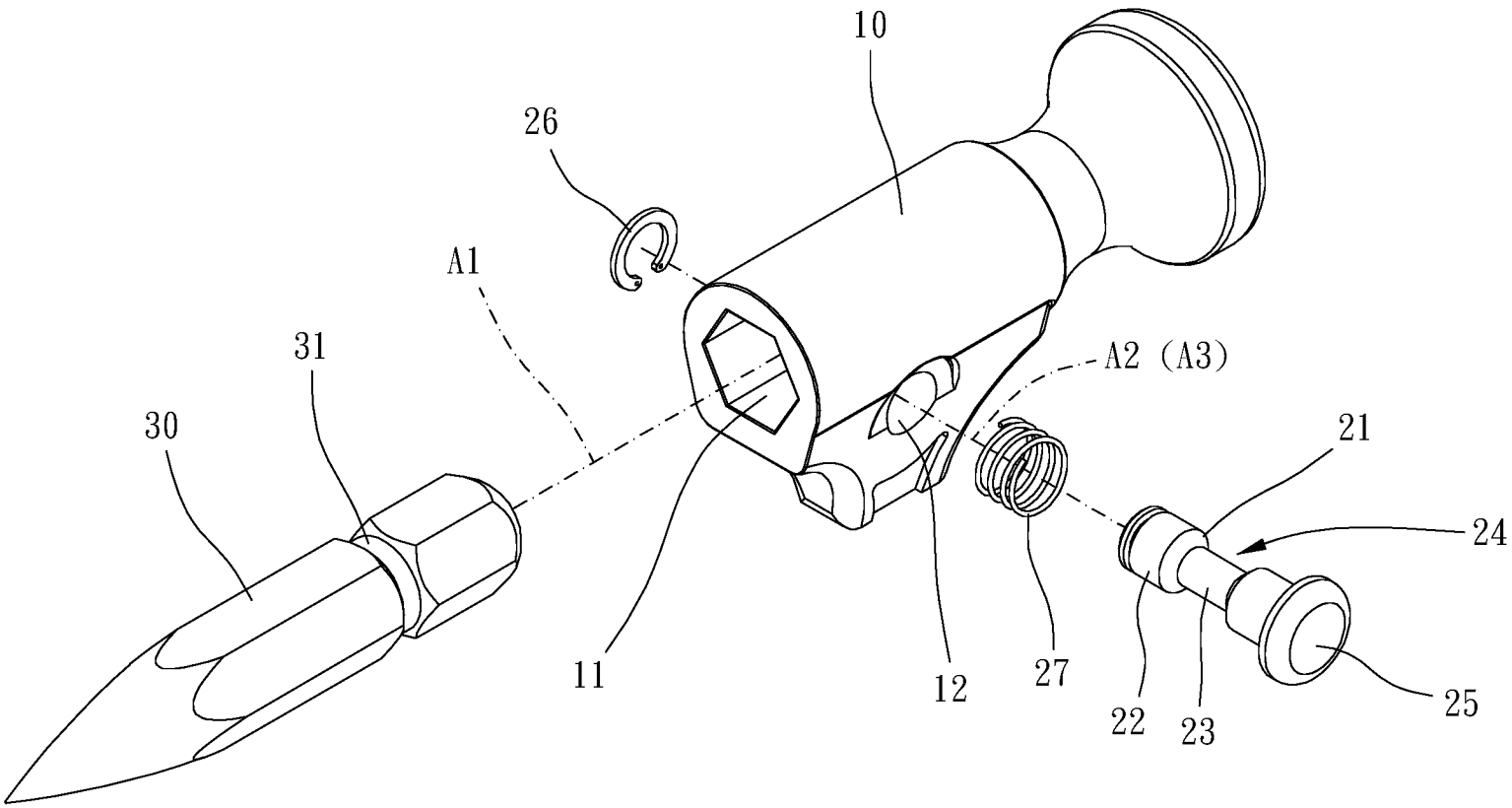
FIG. 2 is a breakdown drawing of a preferable embodiment of the present invention.
Figure 3:
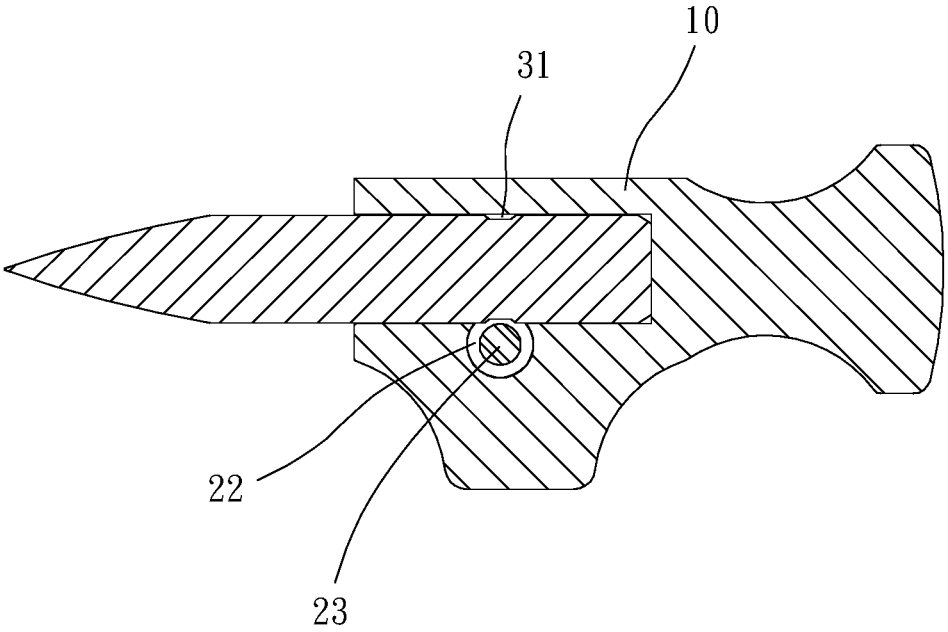
FIG. 3 is an axially cross-sectional view of a preferable embodiment of the present invention.

Please refer to FIGS. 1 to 5 for a preferable embodiment of the present invention. A replaceable tool 1 of the present invention includes a main body 10 and a control member 20.

The main body 10 includes a connecting hole 11 extending along a first axis A1; the control member 20 is inserted within the main body 10 and includes a detent member 21, and the control member 20 is movable between a locked position (FIG. 4) and a release position (FIG. 5) along a second axis A2 lateral (perpendicular or non-parallel) to the first axis A1. When the control member 20 is located in the locked position, the detent member 21 radially protrudes within the connecting hole 11; when the control member 20 moves from the locked position to the release position, the detent member 21 is away from the first axis A1. Whereby, it is quick and easy to replace an object (such as a tool bit, extension rod or the like) inserted in the connecting hole 11.

The control member 20 includes an enlarged section 22 and a narrowed section 23, and the detent member 21 is disposed on the enlarged section 22. When the control member 20 is located in the release position, the detent member 21 does not protrude within the connecting hole 11, and the narrowed section 23 and the connecting hole 11 radially correspond to each other. In this embodiment, the detent member 21 is disposed around the enlarged section 22, the narrowed section 23 is a cylindrical rod, and the enlarged section 22 and the narrowed section 23 are axially connected with each other. Between the enlarged section 22 and the narrowed section 23 is an annular groove 24, the detent member 21 is disposed around an end of the enlarged section 22. The control member 20 may be non-circular, and the detent member 21 may include at least one boss, tab or the like. The connecting hole is polygonal, the narrowed section 23 extends in parallel to the second axis A2 and parallel to a side 111 of the connecting hole which is parallel to the first axis A1 and the second axis A2, and the detent member 211 includes an inclined surface 211 which is inclined to the second axis A2 and extends away from the narrowed section 23.

Specifically, the control member 20 includes a shaft 25 disposed through a through hole 12 of the main body 10 along the second axis A2, a limitation member 26 at an end of the shaft 25, and an elastic member 27 between the main body 10 and another end of the shaft 25. The limitation member 26 is blocked at a side of the main body 10. The elastic member 27 urges the control member 20 toward the locked position so that the limitation member 26 restricts the control member 20 in the locked position. The control member 20 further includes an end portion 28 which enlarges radially, and the end portion 28 is configured for effective operation by pressing. When the control member 20 is located in the release position, a tangent line T1 which is tangent to an outer surface of the main body 10 and perpendicular to the second axis A2 passes through the end portion 28, It is indicative that a finger can press the control member 20 and moves to be aligned with the tangent line T1, wherein the control member 20 is exactly located in the release position, and thus it is quick and easy to operate and release.

The main body 10 further includes a recess 13, and when the control member 20 is located in the locked position, the limitation member 26 is received in the recess 13. A tangent line T2 which is tangent to an outer surface of the main body 10 and perpendicular to the second axis A2 passes through the end portion 28. When the control member 20 is located in the locked position, an end face 29 of the shaft 25 axially opposite to the end portion 28 is located between the tangent line T2 and the limitation member 26, which prevents external impact and unintended pressing. The main body 10 further includes a recess 14, and the elastic member 27 can be stably received in the recess 14, thus reducing the thickness of the replaceable tool. The main body 10 further includes two planes 15, 16 opposite to each other. In this embodiment, the two planes 15, 16 are bottom sides of the recess 13, 14, the second axis A2 and an axis A3 of the through hole 12 are perpendicular to the two planes 15, 16, and the control member 20 is disposed through the two planes 15, 16. Specifically, the limitation member 26 and the elastic member 27 respectively correspond to the two planes 15, 16 for stable abutment.

Figure 4:
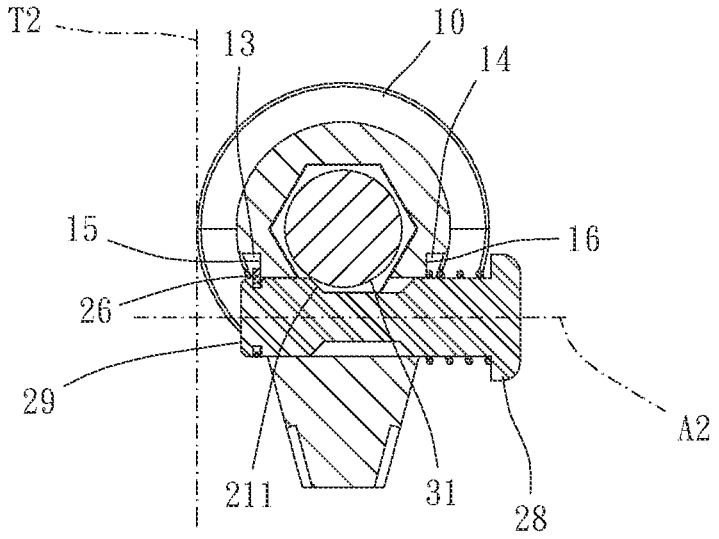
FIG. 4 is a radially cross-sectional view of a preferable embodiment of the present invention.
Figure 5:
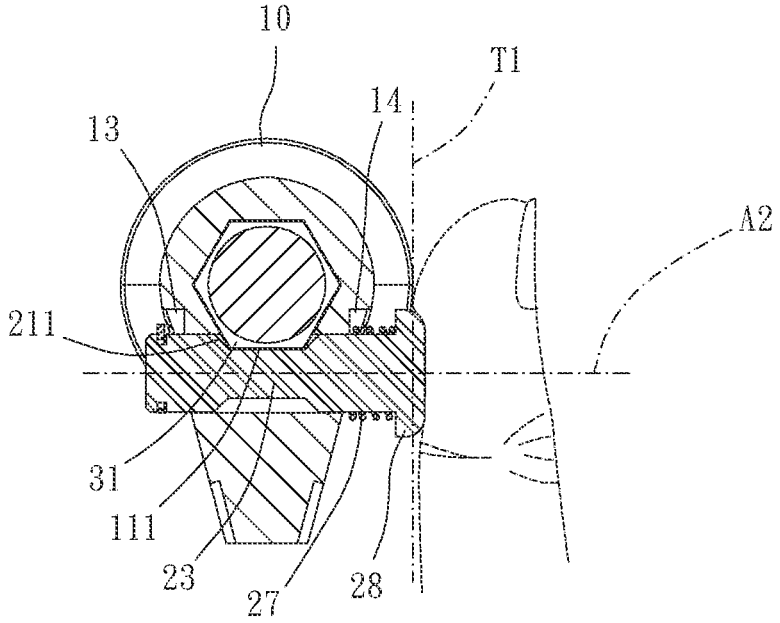
FIG. 5 is a drawing showing operation of a preferable embodiment of the present invention.

The replaceable tool 1 further includes a replaceable member 30 inserted within the connecting hole 11. When the control member 20 is located in the locked position, the replaceable member 30 is axially blocked by the detent member 21 so that the replaceable member 30 is non-detachable from the connecting hole 11, for example, the detent member 21 is engaged within a groove 31 of the replaceable member 30 to lock the replaceable member 30 (FIG. 4). When the control member 20 is located in the release position, the replaceable member 30 is free of being blocked by the detent member 21 so that the replaceable member 30 is detachable from the connecting hole 11, for example, the detent member 21 moves out of the groove 31 of the replaceable member 30 to release the replaceable member 30 (FIG. 5). In this embodiment, the replaceable member 30 is a chisel. The replaceable member may be a tool bit (such as screwdriver), cutting blade, extension rod or the like. As a result, the replaceable member can be quickly and easily replaced according to various requirements. The replaceable member 30 is polygonal, and the replaceable member 30 has a cross-sectional profile matching with a cross-sectional profile of the connecting hole. When the control member 20 is located in the locked position, the inclined surface 211 of the detent member 21 is located within the groove 31 of the replaceable member 30.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A replaceable tool, including:

a main body, including a connecting hole extending along a first axis, and further including a through hole extending along a second axis perpendicular to the first axis; and a control member, inserted within the through hole of the main body and including a detent member, being movable between a locked position and a release position in a direction parallel to a and along the second axis;

wherein when the control member is located in the locked position, the detent member radially protrudes within the connecting hole;

when the control member moves from the locked position to the release position, the detent member is clear from the connecting hole;

wherein the connecting hole is polygonal, the control member further includes a narrowed section extending in parallel to the second axis and perpendicular to a side of the connecting hole which is parallel to the first axis, wherein the detent member includes an inclined surface which is inclined to the second axis and extends away from the narrowed, and wherein when the control member is located in the release position, the narrowed section is entirely located outside the connecting hole.

2. The replaceable tool of claim 1, wherein the control member further includes an enlarged section, the detent member is disposed on the enlarged section, and when the control member is located in the release position, the detent member does not protrude within the connecting hole, and the narrowed section and the connecting hole radially correspond to each other.

3. The replaceable tool of claim 2, wherein the detent member is disposed around the enlarged section, the narrowed section is a cylindrical rod, and the enlarged section and the narrowed section are axially connected with each other.

4. The replaceable tool of claim 1, wherein the control member includes a shaft disposed through the through hole of the main body along the second axis, a limitation member at an end of the shaft, and an elastic member between the main body and another end of the shaft, and the limitation member is blocked at a side of the main body.

5. The replaceable tool of claim 4, wherein the control member further includes an end portion which enlarges radially, when the control member is located in the locked position, an end face of the shaft axially opposite to the end portion is located between a tangent line and the limitation member, and the tangent line is tangent to an outer surface of the main body and perpendicular to the second axis.

6. The replaceable tool of claim 4, wherein the main body further includes a recess, and when the control member is located in the locked position, the limitation member is received in the recess.

7. The replaceable tool of claim 4, wherein the main body further includes a recess, and the elastic member is received in the recess.

8. The replaceable tool of claim 1, further including a replaceable member which is polygonal and inserted within the connecting hole, wherein the replaceable member has a cross-sectional profile matching with a cross-sectional profile of the connecting hole, when the control member is located in the locked position, the inclined surface of the detent member is located within a groove of the replaceable member and the replaceable member is axially blocked by the detent member so that the replaceable member is non-detachable from the connecting hole; and when the control member is located in the release position, the replaceable member is free of being blocked by the detent member so that the replaceable member is detachable from the connecting hole.

9. The replaceable tool of claim 8, wherein the main body further includes two planes opposite to each other, the second axis is perpendicular to the two planes, and the control member is disposed through the two planes.

10. The replaceable tool of claim 1, wherein the control member further includes an end portion which enlarges radially, and when the control member is located in the release position, a tangent line which is tangent to an outer surface of the main body and perpendicular to the second axis passes through the end portion.

* * * * *